US008959942B2

(12) United States Patent
Mochizuki et al.

(10) Patent No.: US 8,959,942 B2
(45) Date of Patent: Feb. 24, 2015

(54) OUTDOOR UNIT FOR AIR CONDITIONER

(75) Inventors: Tatsuya Mochizuki, Tokyo (JP); Toshiyuki Kubono, Tokyo (JP); Norio Yamauchi, Tokyo (JP); Hiroyuki Jinnai, Tokyo (JP)

(73) Assignee: Mitsubishi Electric Corporation, Chiyoda-Ku, Tokyo (JP)

( * ) Notice: Subject to any disclaimer, the term of this patent is extended or adjusted under 35 U.S.C. 154(b) by 639 days.

(21) Appl. No.: 12/723,788

(22) Filed: Mar. 15, 2010

(65) Prior Publication Data

US 2010/0319380 A1 Dec. 23, 2010

(30) Foreign Application Priority Data

Jun. 19, 2009 (JP) ..... 2009-145973

(51) Int. Cl.
*F24F 1/38* (2011.01)
*F24F 1/06* (2011.01)
*F24F 13/20* (2006.01)

(52) U.S. Cl.
CPC ... *F24F 1/38* (2013.01); *F24F 1/06* (2013.01); *F24F 13/20* (2013.01)
USPC ..... 62/285; 62/272; 62/283; 62/262

(58) Field of Classification Search
CPC ..... F24F 13/20; F24F 13/24; F24F 1/38; F24F 1/56; F24F 2013/205; F25D 2317/0681; F04D 29/4226
USPC ..... 62/298, 261, 262, 263, 259.1, 426, 272, 62/283, 285; 165/70, 134.1; 454/224, 226, 454/227, 356, 367, 368, 201, 198, 204, 223, 454/348, 291, 337; 52/11, 24, 97, 198; 248/48.1; 312/229; 415/204, 211.1, 415/211.2; 416/247 R, 169 A
See application file for complete search history.

(56) References Cited

U.S. PATENT DOCUMENTS 2,142,895 A * 1/1939 Hanson ..... 62/241
2,294,664 A * 9/1942 Hubbard ..... 454/204
2,469,955 A * 5/1949 Eberhart ..... 62/428
2,874,551 A * 2/1959 Bradbury et al. ..... 62/262

(Continued)

FOREIGN PATENT DOCUMENTS

JP 58-69766 U 5/1983
JP 4-132336 U 12/1992

(Continued)

OTHER PUBLICATIONS

Office Action issued on Oct. 2, 2012 by the Japanese Patent Office in corresponding Japanese Patent Application No. 2009-145973, and a partial English translation thereof.

(Continued)

*Primary Examiner* — Mohammad M Ali
*Assistant Examiner* — Raheena Rehman
(74) *Attorney, Agent, or Firm* — Buchanan Ingersoll & Rooney PC

(57) ABSTRACT

The present invention aims to prevent freezing of water droplets, etc. between a fan and a bell mouth. An outdoor unit for an air conditioner includes an eaves member that is placed above an air outlet formed by a bell mouth in close adherence with a front panel, and that protrudes toward a side of an outlet grille. Particularly, the eaves member is placed with a space from the outlet grille.

4 Claims, 12 Drawing Sheets

(56) References Cited

U.S. PATENT DOCUMENTS

| | | | | |
|---|---|---|---|---|
| 2,901,989 | A * | 9/1959 | Mondi | 52/3 |
| 3,274,919 | A * | 9/1966 | Wegman | 454/316 |
| 3,313,123 | A * | 4/1967 | Ware | 62/272 |
| 3,719,059 | A * | 3/1973 | Cavis | 62/285 |
| 4,353,680 | A * | 10/1982 | Hiraoka et al. | 415/222 |
| 4,665,654 | A * | 5/1987 | Stedron et al. | 49/484.1 |
| 4,741,669 | A * | 5/1988 | Shimokawabe | 415/223 |
| 5,410,992 | A * | 5/1995 | Hunt et al. | 123/41.49 |
| 5,423,660 | A * | 6/1995 | Sortor | 416/189 |
| 5,567,200 | A * | 10/1996 | Swartzendruber | 454/338 |
| 5,575,622 | A * | 11/1996 | Zimmerman et al. | 415/213.1 |
| 5,655,382 | A * | 8/1997 | Chen | 62/262 |
| 6,053,004 | A * | 4/2000 | Beppu et al. | 62/285 |
| 6,189,492 | B1 * | 2/2001 | Brown | 123/41.49 |
| 6,588,228 | B2 * | 7/2003 | Choi | 62/426 |
| 6,701,738 | B2 * | 3/2004 | Kobayashi et al. | 62/262 |
| 7,032,402 | B2 * | 4/2006 | Braswell | 62/259.1 |
| 7,260,953 | B2 * | 8/2007 | Kim et al. | 62/262 |
| 7,340,911 | B2 * | 3/2008 | Ha et al. | 62/262 |
| 7,918,101 | B2 * | 4/2011 | Sugiyama et al. | 62/259.1 |
| 8,001,800 | B2 * | 8/2011 | Kashiwa et al. | 62/259.1 |
| 2002/0174671 | A1 * | 11/2002 | Wilkinson | 62/259.1 |
| 2003/0226369 | A1 * | 12/2003 | Comanescu et al. | 62/259.1 |
| 2006/0130516 | A1 * | 6/2006 | Sugiyama et al. | 62/507 |
| 2007/0044496 | A1 * | 3/2007 | Ha et al. | 62/262 |
| 2007/0227177 | A1 * | 10/2007 | Leon et al. | 62/419 |
| 2008/0236518 | A1 * | 10/2008 | Schaffer et al. | 123/41.49 |
| 2009/0277205 | A1 * | 11/2009 | Matsuda et al. | 62/259.1 |

FOREIGN PATENT DOCUMENTS

| | | | |
|---|---|---|---|
| JP | 07-324779 | A | 12/1995 |
| JP | 08-178364 | A | 7/1996 |
| JP | 8-178365 | A | 12/1996 |
| JP | 2000-104952 | A | 4/2000 |
| JP | 2005083587 | A | 3/2005 |
| JP | 2008-286465 | A | 11/2008 |
| JP | 2009257603 | A | 11/2009 |

OTHER PUBLICATIONS

Extended Search Report issued on May 22, 2014 by the European Patent Office, in corresponding European Patent Application No. 10155742.9 (6 pages).

* cited by examiner

OUTDOOR UNIT FOR AIR CONDITIONER

BACKGROUND OF THE INVENTION

1. Field of the Invention

The present invention relates to an outdoor unit for an air conditioner that prevents freezing of water droplets, etc. between a fan and a bell mouth, for example.

2. Background Art

In an outdoor unit for an air conditioner, water droplets from rain, snow, etc., attached to a surface of a front panel of a casing, or water droplets formed from melted snow on top of the casing drop along the surface of the front panel to enter a gap between a bell mouth and a fan during a heating operation. When the outside air temperature is low, the temperature of blowout air from the fan can be equal to or below the freezing point. In this case, the water droplets entered the gap between the bell mouth and the fan freeze. Particularly, when the amount of water droplets is large, frozen ice can grow and contact with the fan to make extraordinary noise, or interrupt rotation of the fan to stop the outdoor unit abnormally.

Japanese Utility Model Publication No. 4-132336 describes an outdoor unit for an air conditioner wherein a seal member is formed to seal a gap between a casing and an outlet grille with a width equal to or larger than a diameter of an air outlet above the air outlet in order to prevent freezing of water droplets, etc. between a fan and a bell mouth.

DESCRIPTION OF THE RELATED ART

However, there are following problems in preventing water droplets from flowing into the bell-mouth part by sealing the gap between the casing and the outlet grille as in the conventional way.

(1) Generally, the outlet grille is formed by welding an iron wire. However, a flange like a frame is necessary at a periphery, or at least in the upper part of the outlet grille in order to seal the gap between the casing and the upper part of the outlet grille. Farming the flange in the outlet grille impairs design of the exterior appearance. Further, it is necessary to combine a plate-like member with the iron wire part in order to form the flange in the outlet grille, which results in higher manufacturing cost.

(2) Generally, four corners of the outlet grille are fixed to the casing with screws. However, fixing the outlet grille only at its four corners to the casing with screws causes the outlet grille to wobble and vibrate, and makes it difficult to seal the clearance at the center part with a seal member. Therefore, it is necessary to increase the number of screws to fix the outlet grille to the casing in order to seal the gap between the casing and the upper part of the outlet grille. An increase in the number of the screws impairs design of the exterior appearance and worsens work efficiency in production or the like.

Furthermore, as a method to decrease the number of the parts to fix the outlet grille to the casing with screws, there is a method to fix only the both ends of the outlet grille, and to press the center part thereof against the casing making use of elasticity of the outlet grille itself. In this way, it is possible to inhibit the outlet grille from wobbling and making vibration noises, and to decrease the number of the parts to fix with screws at the same time. However, in order to use this method, it is necessary to fix the outlet grille in a slightly deflected state from the both ends to the center part to the casing. For this reason, when the gap between the casing and the upper part of the outlet grille is sealed in addition to use of this method, it is necessary to make the shape of the seal member in a curve to fit the deflected outlet grille, in which case secure sealing is difficult.

(3) The seal member to be used for sealing the gap between the casing and the upper part of the outlet grille needs to have width similar to thickness. Therefore, generally, a wall of the seal member is formed to a position equal to or more than 10 mm lower from the upper end (surface on the upper side) of the outlet grille. Here, it is necessary to set the diameter of the fan in the outdoor unit for the air conditioner as large as possible relative to the casing in order to improve performance as well as to reduce the size of the product. However, when the wall is formed to the position equal to or more than 10 mm lower from the upper end of the outlet grille, the seal member protrudes to the air path side of airflow generated by the fan, especially at the above and center part of the air outlet. That is, the seal member blocks the airflow generated by the fan. This results in an increase in noise and deterioration of aerodynamic performance.

Thus, as described in Japanese Utility Model Publication No. 4-132336, when the outdoor unit for the air conditioner wherein the gap between the casing and the outlet grille is sealed and water droplets do not flow into the bell mouth part is realized, the outdoor unit needs to have a complicated structure so that design of the exterior appearance is impaired, the manufacturing cost increases, and workability is worsened.

SUMMARY OF THE INVENTION

The present invention aims to prevent water droplets from flowing into a gap between a fan and a bell mouth with a simple structure, for example.

An outdoor unit for an air conditioner according to the present invention includes, for example,

- a casing to store a fan;
- a bell mouth to form an air outlet for an airflow that is generated by the fan stored in the casing;
- an outlet grille to cover the air outlet formed by the bell mouth; and
- an eaves member that is placed above the air outlet in close contact with the casing, and that protrudes toward an outlet grille side, the eaves member being placed with a space from the outlet grille.

BRIEF DESCRIPTION OF THE DRAWINGS

A complete appreciation of the present invention and many of the attendant advantages thereof will be readily obtained as the same becomes better understood by reference to the following detailed description when considered in connection with the accompanying drawings, wherein.

DESCRIPTION OF THE PREFERRED EMBODIMENT

Embodiment 1

The outdoor unit for the air conditioner according to the first embodiment will be described based on FIG. 1 through FIG. 8.

Figure 1:
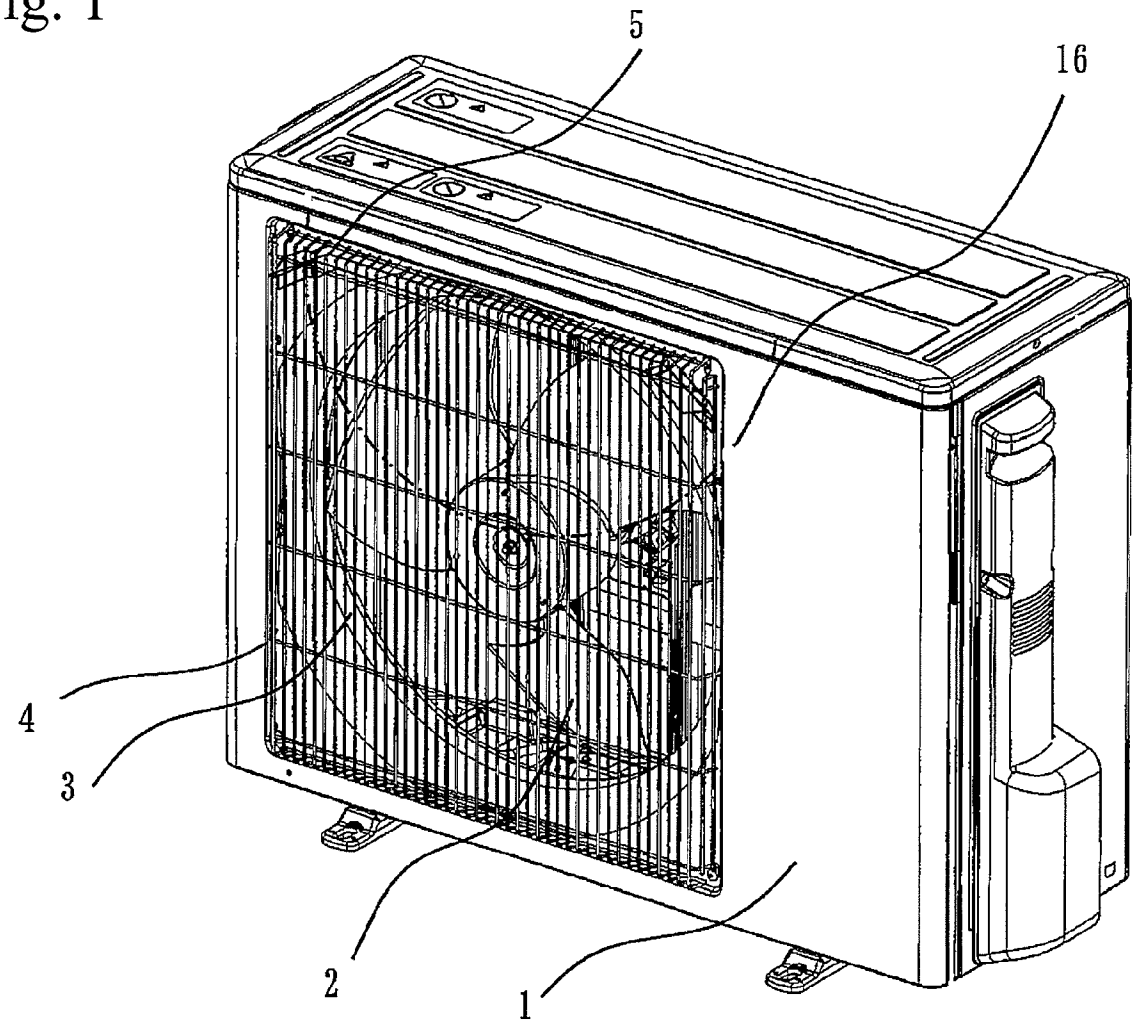
FIG. 1 is a perspective view of an outdoor unit for an air conditioner according to the first embodiment.

FIG. 1 is a perspective view of the outdoor unit for the air conditioner according to the first embodiment.

Figure 2:
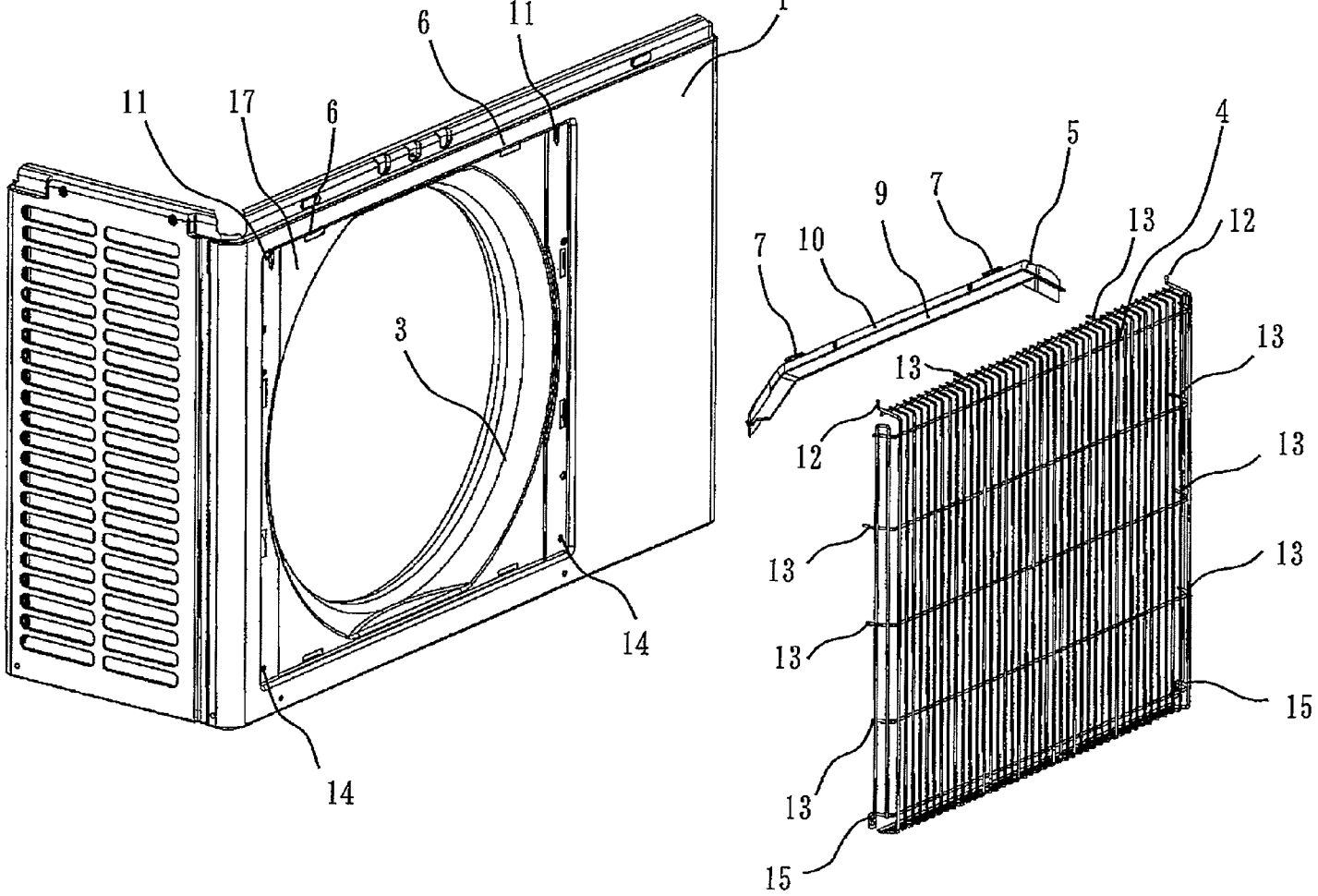
FIG. 2 is a diagram illustrating a state where a front panel 1, an eaves member 5 and an outlet grille 4 are detached from one another.
Figure 3:
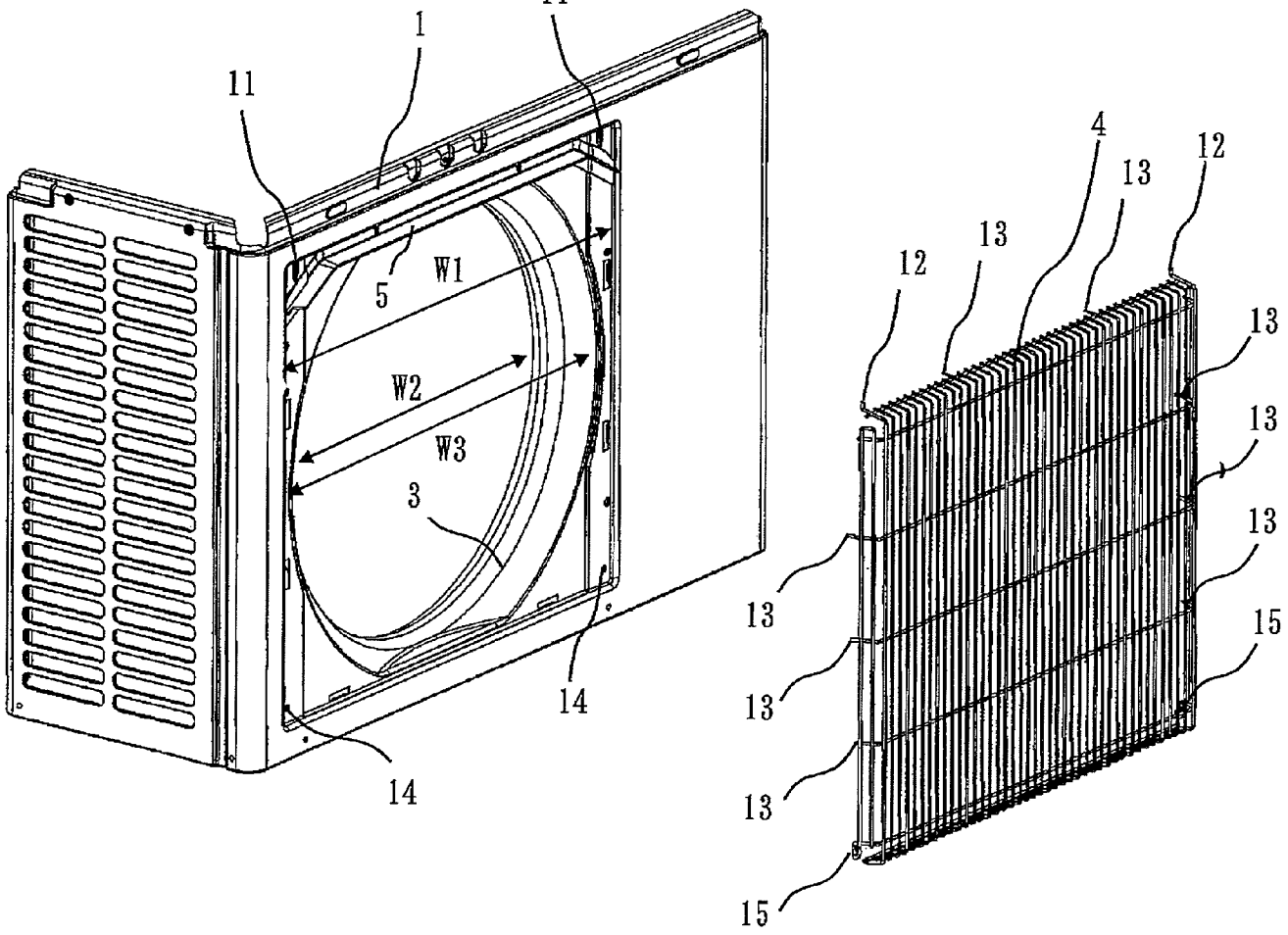
FIG. 3 is a diagram illustrating a state where the eaves member 5 is attached to and the outlet grille 4 is detached from the front panel 1.
Figure 4:
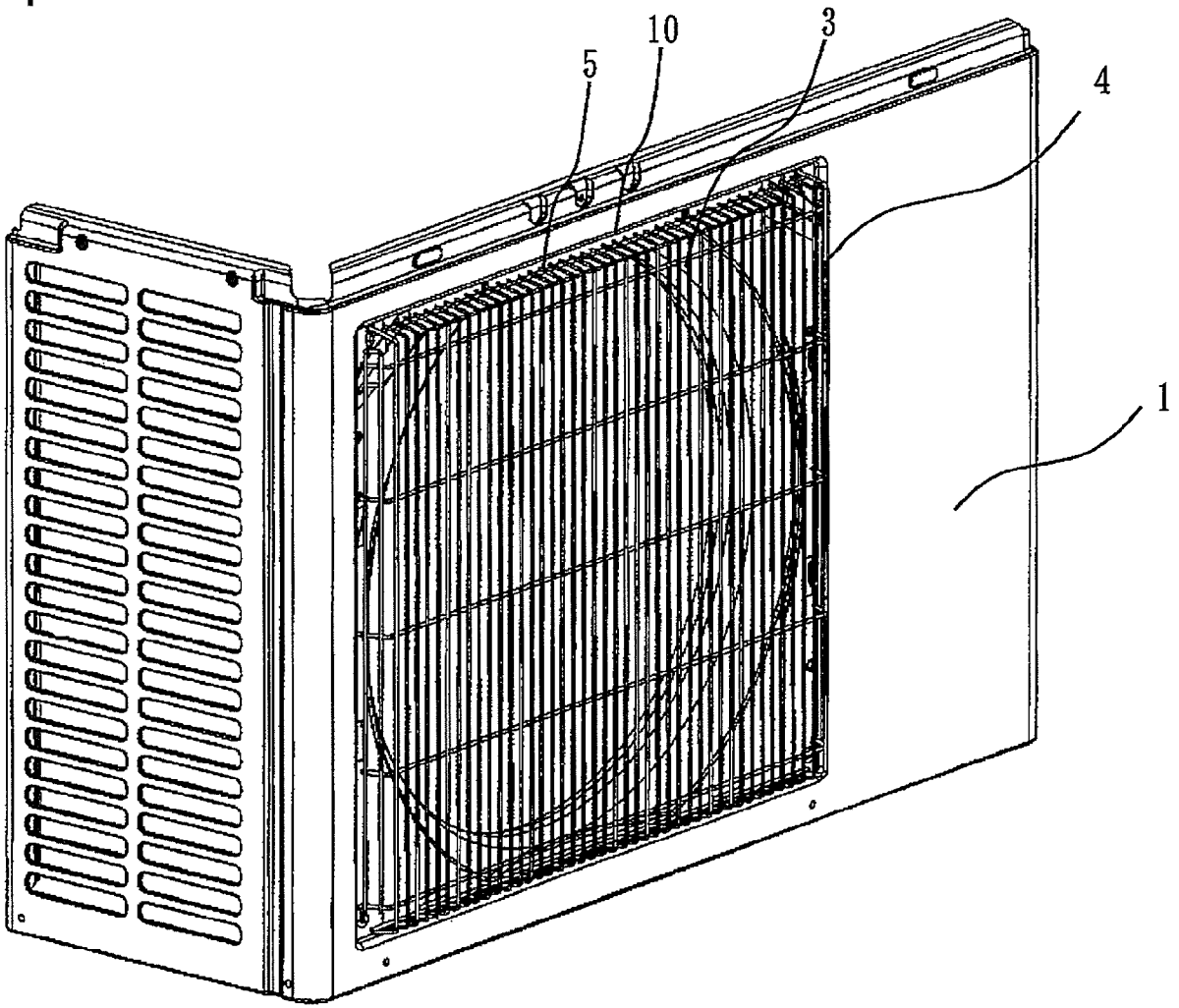
FIG. 4 is a diagram illustrating a state where the eaves member 5 and the outlet grille 4 are attached to the front panel 1.

FIG. 2 through FIG. 4 are perspective views of the front surface part of the outdoor unit for the air conditioner according to the first embodiment. Particularly, FIG. 2 is a diagram illustrating the state where the front panel 1, the eaves member 5 and the outlet grille 4 are detached from one another. FIG. 3 is a diagram illustrating the state where the eaves member 5 is attached to and the outlet grille 4 is detached from the front panel 1. FIG. 4 is a diagram illustrating the state where the eaves member 5 and the outlet grille 4 are attached to the front panel 1.

Figure 5:
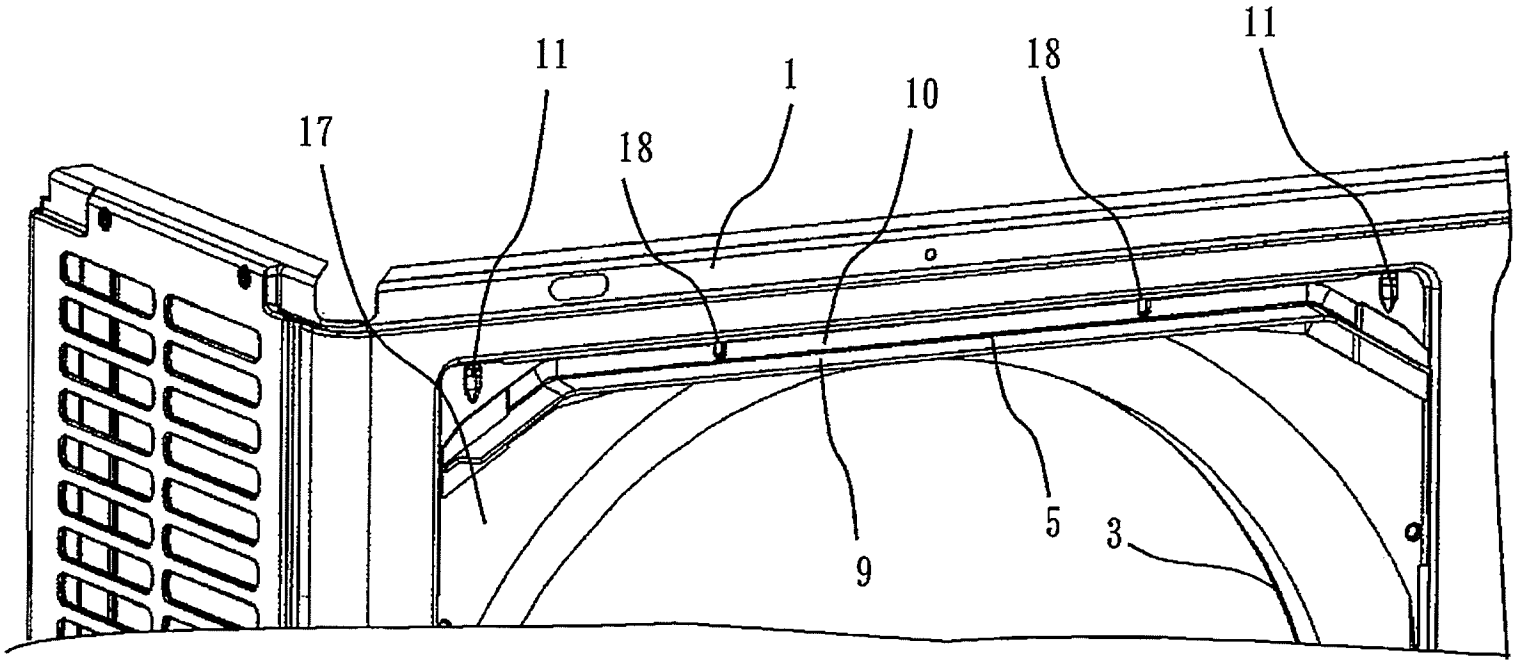
FIG. 5 is a perspective view of a front surface part of the outdoor unit for the air conditioner according to the first embodiment, and is an enlarged view of the upper part.

FIG. 5 is a perspective view of the front surface part of the outdoor unit for the air conditioner according to the first embodiment, and is an enlarged view of the upper part. FIG. 5 describes a state where the outlet grille 4 is detached.

Figure 6:
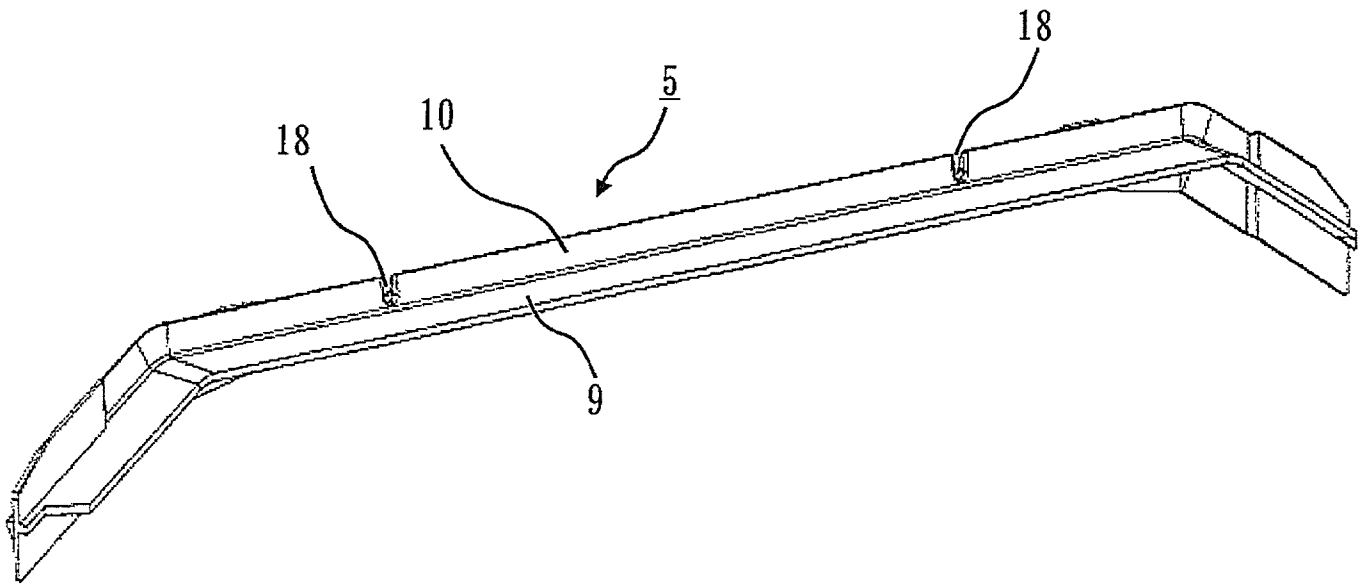
FIG. 6 is a front perspective view of the eaves member 5 according to the first embodiment.

FIG. 6 is a front perspective view of the eaves member 5 according to the first embodiment.

Figure 7:
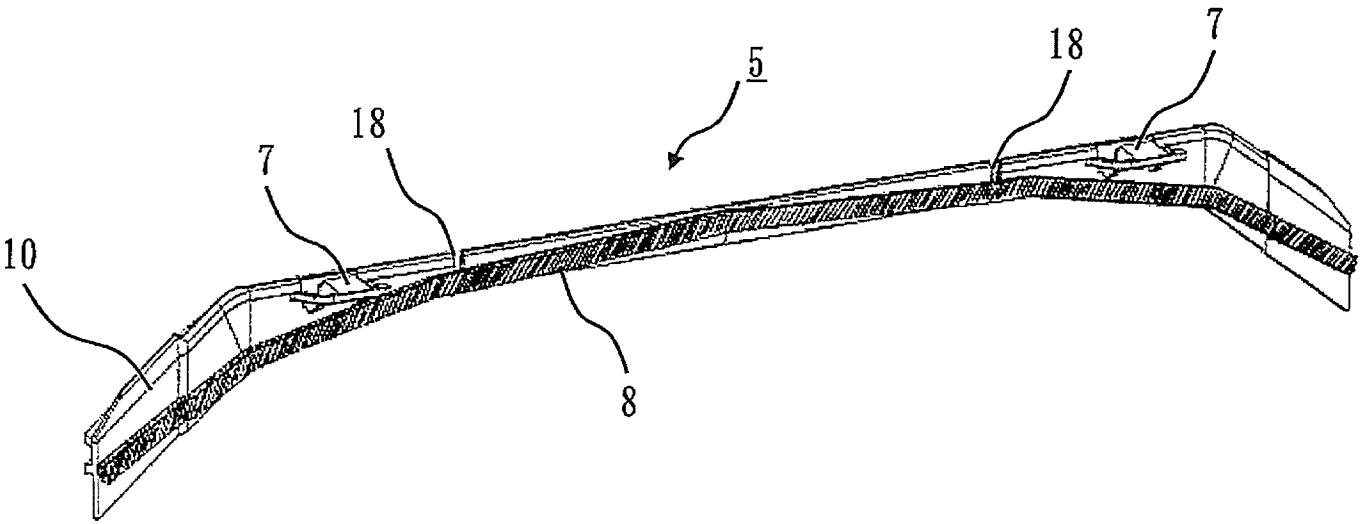
FIG. 7 is a back perspective view of the eaves member 5 according to the first embodiment.

FIG. 7 is a back perspective view of the eaves member 5 according to the first embodiment.

Figure 8:
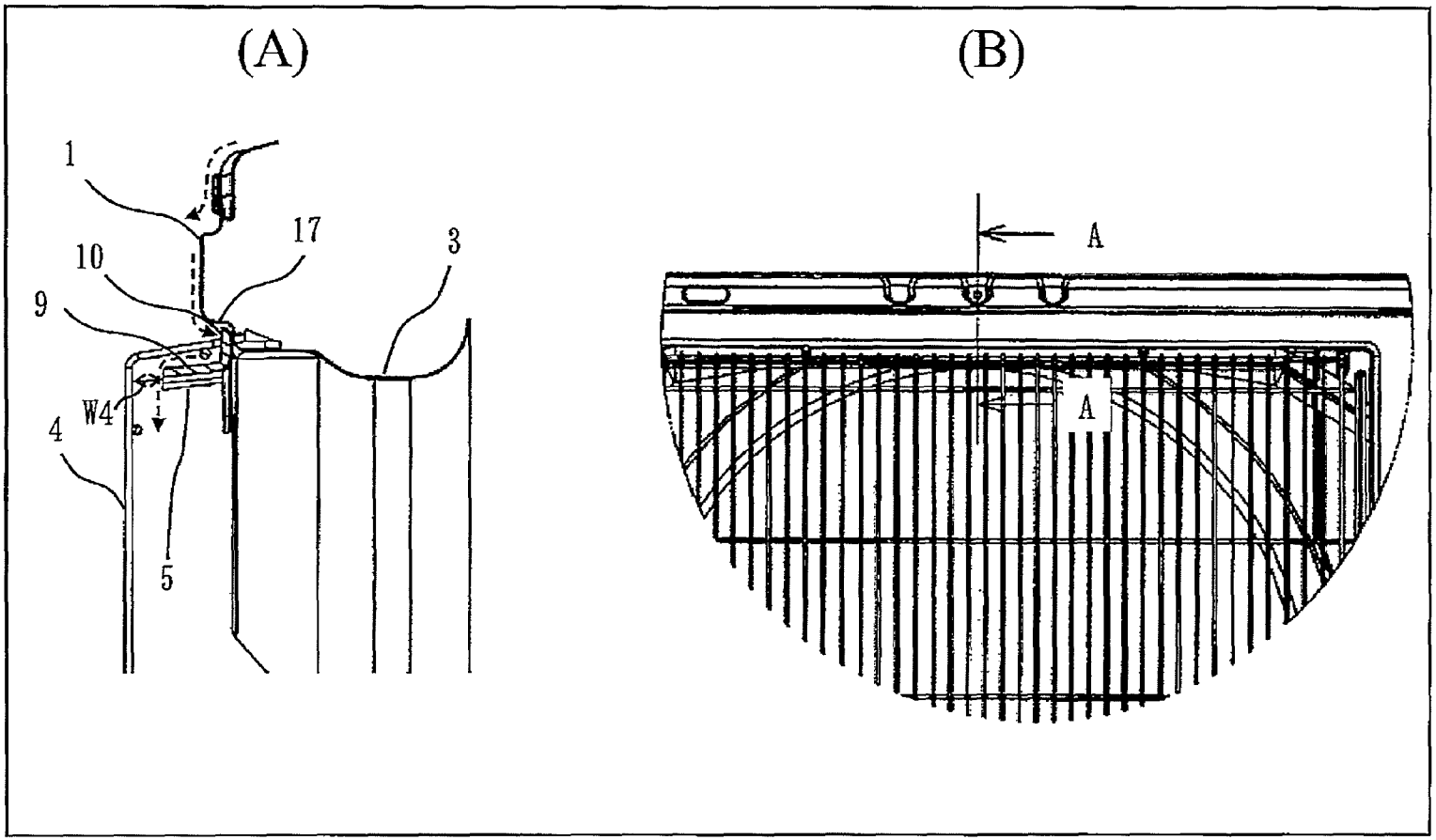
FIG. 8 is a cross-section view of the upper part of the outdoor unit for the air conditioner according to the first embodiment.

FIG. 8 is a cross-section view of the upper part of the outdoor unit for the air conditioner according to the first embodiment. Particularly, (A) in FIG. 8 is A-A' cross-section view as shown in (B) in FIG. 8, and (B) in FIG. 8 is a diagram to show the position of (A) in FIG. 8, which is a diagram to illustrate the front surface part of the outdoor unit for the air conditioner according to the first embodiment, and to show a dashed line part 16 in FIG. 1. The dashed arrow in (A) in FIG. 8 shows a flow of water droplets.

As illustrated in FIG. 1, the outdoor unit for the air conditioner according to the first embodiment includes a casing (main body of the outdoor unit) constituted by the front panel 1, etc., a fan 2 (propeller fan) housed in the casing, a bell mouth 3 in a cylindrical shape to form an air outlet of airflow generated by the fan 2, an outlet grille 4 in an approximately square shape to cover the front surface of the air outlet formed by the bell mouth, and an eaves member 5 placed above the air outlet.

As illustrated in FIG. 2, the bell mouth 3 and a bell mouth surrounding part 17 in an approximately square shape are integrally formed with the front panel 1, and are formed by a drawing process of a plate. The bell mouth 3, the bell mouth surrounding part 17 and the front panel 1 can be formed separately as well.

The bell mouth surrounding part 17 is formed slightly lower in level than the part of the front panel 1 to the inner direction of the casing. Further, the diameter of the bell mouth 3 becomes gradually larger in the vicinity of the front panel 1, from the inner side of the casing to the front panel 1 side. That is, the bell mouth 3 flares out in the vicinity of the front panel 1. More specifically, the diameter (W3 in FIG. 3) in the vicinity of the bell mouth surrounding part 17 is larger than the diameter (W2 in FIG. 3) of the inner section of the casing.

As illustrated in FIG. 2, rectangle holes 6 to attach the eaves member 5 are formed in the upper section of the bell mouth surrounding part 17. Further, as illustrated in FIG. 7, lugs 7 are formed on the rear side of the eaves member 5.

The lugs 7 formed in the eaves member 5 are inserted into the rectangle holes 6 formed in the section of the bell mouth surrounding part 17, and the lugs 7 fit into the rectangle holes 6 by elasticity of the lugs 7 so that the eaves member 5 is secured to the front panel 1 as illustrated in FIG. 3.

As illustrated in FIGS. 2, 3 and 5, U-shaped grill attaching holes 11 to attach the outlet grille 4 are formed in the vicinity of both right and left ends in the upper section of the bell mouth surrounding part 17, and screw holes 14 to attach the outlet grille 4 are formed in the vicinity of the both right and left ends in the lower section of the bell mouth surrounding part 17. Further, the outlet grille 4 is a reticular component assembled by welding an iron wire, and extension portions 12 of the iron wire are formed at the both right and left ends in the upper part of the outlet grille 4, and screw fixing portions 15 through which screws pass are formed at the both right and left ends in the lower part of the outlet grille 4, as illustrated in FIG. 2 and FIG. 3.

In a state where the eaves member 5 is attached to the front panel 1, the extension portions 12 in the outlet grille 4 are inserted into the grille attaching holes 11 formed in the section of the bell mouth surrounding part 17, and further, the screws passed through the screw fixing portions 15 in the outlet grille 4 are inserted into the screw holes 14 formed in the section of the bell mouth surrounding part 17 and secured. In this way, the outlet grille 4 is secured to the front panel 1 as illustrated in FIG. 4.

Here, the eaves member 5 has an approximately the same horizontal width as the width W1 of the bell mouth surrounding part 17 formed in the front panel 1, as shown in FIG. 3. That is, the eaves member 5 has a width equal to or larger than the horizontal width W2 (diameter of the bell mouth 3 at the inner section of the casing) of the air outlet. It is preferable that the eaves member 5 has a width equal to or larger than the diameter W3 in the vicinity of the bell mouth surrounding part 17.

Further, the eaves member 5 has a protruding section 9 that protrudes toward the side of the outlet grille 4 when the eaves member 5 is attached to the front panel 1, and an adherence section 10 that is in a plane approximately parallel to the plane of the front panel 1 and that is in close contact with the front panel 1 when the eaves member 5 is attached to the front panel 1, as illustrated in FIG. 5 and FIG. 6, etc. Particularly, a seal member 8 is formed between the rear portion of the adherence section 10 and the front panel 1 to closely adhere the adherence section 10 and the front panel 1 with no space between them, as illustrated in FIG. 7.

Additionally, as shown in (A) in FIG. 8, the protruding section 9 slightly slants downward toward its end. That is, the protruding section 9 slants downward toward the side of the outlet grille 4 from the side of the front panel 1 when the eaves member 5 is attached to the front panel 1.

As shown in (A) in FIG. 8, when the eaves member 5 and the outlet grille 4 are attached to the front panel 1, a clearance W4 of approximately 2 to 10 mm exists between the end of the protruding section 9 in the eaves member 5 and the outlet grille 4.

Therefore, in the outdoor unit for the air conditioner according to the first embodiment, when water droplets run down to the bell mouth 3 side along the surface of the front panel 1 from the upper part of the front panel 1, the water droplets flow over the protruding section 9 in a gutter shape of the eaves member 5, and run down to the outlet grill 4 side, as described by a dashed arrow in (A) in FIG. 8. That is, it is possible to prevent water droplets from flowing into the gap between the bell mouth 3 and the fan 2.

Particularly, the adherence section 10 in the eaves member 5 is in a plane parallel to the front panel 1, and the seal member 8 exists between the adherence section 10 and the front panel 1. Therefore, the gap between the front panel 1 and the eaves member 5 is in a watertight state, so that there is no chance that water droplets flow into the bell mouth 3 side after passing between the front panel 1 and the eaves member 5.

Thus, even when the outdoor air temperature is low and a blowout air temperature of the fan 2 is equal to or lower than the freezing point, freezing does not occur between the fan 2 and the bell mouth 3, and it is possible to prevent the fan 2 from making extraordinary noise, etc. due to freezing.

Further, in the outdoor unit for the air conditioner according to the first embodiment, a clearance exists between the front panel 1 and the outlet grille 4. That is, the gap between the front panel 1 and the outlet grille 4 is not sealed with a seal member. Therefore, it is not necessary to form a flange like a frame in the outlet grille as in the conventional way. Thus, there is an advantage in design of the exterior appearance and the manufacturing cost.

Particularly, in the outdoor unit for the air conditioner according to the first embodiment, when the outlet grill 4 is mounted on the front panel 1 in a state in which the eaves member 5 is attached to the front panel 1, the main part of the adherence section 10 in the eaves member 5 is covered by the outlet grille 4 even though a part of the adherence section 10 appears above the outlet grille 4, as illustrated in FIG. 4. Therefore, the eaves member 5 is unnoticeable from outside, and is superior in design.

Further, the outdoor unit for the air conditioner according to the first embodiment can easily employ the method to press the center part of the outlet grille 4 against the casing making use of elasticity of the outlet grille 4 itself.

As illustrated in FIG. 2 and FIG. 3, plural contact portions 13 are provided between the extension portions 12 and the screw fixing portions 15 formed at the four corners in the outlet grille 4. When the outlet grille 4 is attached to the front panel 1, each of the contact portions 13 contacts with the front panel 1 by attaching the outlet grille 4 in a deflected state to the front panel 1. Here, as illustrated in FIG. 6 and FIG. 7, cutouts 18 through which the contact portions 13 in the outlet grille 4 penetrate are formed in the adherence section 10 in the eaves member 5. That is, the contact portions 13 provided at the upper part of the outlet grille 4 among the contact portions 13 penetrate the cutouts 18 formed in the adherence section 10 of the eaves member 5, and contact with the front panel 1 directly.

Here, in the outdoor unit for the air conditioner according to the first embodiment, a clearance exists between the eaves member 5 and the outlet grille 4. Therefore, there is a space enough for the outlet grille 4 to bow and to be attached to the front panel 1 in the clearance. Further, in the outdoor unit for the air conditioner according to the first embodiment, since the gap between the eaves member 5 and the outlet grille 4 needs not be sealed with a seal member, no inconvenience is caused by the outlet grille 4 bowing in a curved line. Therefore, since it is possible to easily employ the method to press the center part of the outlet grille 4 against the casing making use of elasticity of the outlet grille 4 itself, and since it is not necessary to increase the number of screws, there is an advantage in design of the exterior appearance and workability of manufacturing, etc.

In addition, in the outdoor unit for the air conditioner according to the first embodiment, the both right and left ends of the eaves member 5 slant downward, and the eaves member 5 does not interfere with the outlet grille 4 when the extension portions 12 of the outlet grille 4 are inserted into the grille attaching holes 11, as illustrated in FIG. 3 and FIG. 5 through FIG. 7. Therefore, the outlet grille 4 can be directly and easily fixed to the front panel 1, which allows for extremely high workability of manufacturing, etc.

Further, in the outdoor unit for the air conditioner according to the first embodiment, most of the eaves member 5 does not project toward the air outlet side, as illustrated in FIGS. 5 and 8. Therefore, airflow created by the fan is less affected by the eaves member 5, and there is little chance that noise increases or aerodynamic performance deteriorates.

As illustrated in FIGS. 6, 7 and 8, in the outdoor unit for the air conditioner according to the first embodiment, the eaves member 5 is formed to have T-shaped cross sections at its both right and left ends by the protruding section 9 and the adherence section 10. Further, the width of the adherence section 10 formed on the lower side of the protruding section 9 gradually becomes smaller as it nears the center part from the both right and left ends. Then in the vicinity of the center part, the adherence section 10 is formed only on the upper side of the protruding section 9, and the eaves member 5 is formed with an L-shaped cross section.

Thus, in the outdoor unit for the air conditioner according to the first embodiment, the adherence section 10 is formed not only on the upper side but also on the lower side of the protruding section 9 at the ends of the air outlet in the lateral direction where an installation area of the eaves member 5 is large. On the other hand, as it nears the center part of the air outlet in the lateral direction where the air outlet is formed at the nearest part from the upper end of the front panel 1 and where the installation area of the eaves member 5 is small, the size of the adherence section 10 formed on the lower side of the protruding section 9 is gradually reduced, and in the vicinity of the center part of the air outlet in the lateral direction, the adherence section 10 is formed only on the upper side of the protruding section 9.

In addition, the lugs 7 and the cutouts 18 are formed in the eaves member 5 at positions near the both right and left ends where the adherence section 10 is large in width.

Since the eaves member 5 is formed in a shape as described above, and the lugs 7 and the cutouts 18 are allocated in the positions as described above, the adherence section 10 is prevented from protruding to air path side of airflow generated by the fan even in the vicinity of the center part of the air outlet in the lateral direction where the installation area of the eaves member 5 is small.

Incidentally, flame-retarded plastic can be used as a material for the eaves member 5 according to the present invention. This can prevent fire spread from a fire around the outdoor unit. In addition, even when spark, etc. should occur from a part of electric components of the main body, it is possible to prevent fire spread to the outside.

Embodiment 2

An outdoor unit for an air conditioner according to the second embodiment will be explained based on FIG. 9 through FIG. 12. Particularly, only parts in the outdoor unit for the air conditioner according to the second embodiment different from those in the outdoor unit for the air conditioner according to the first embodiment will be explained.

Figure 9:
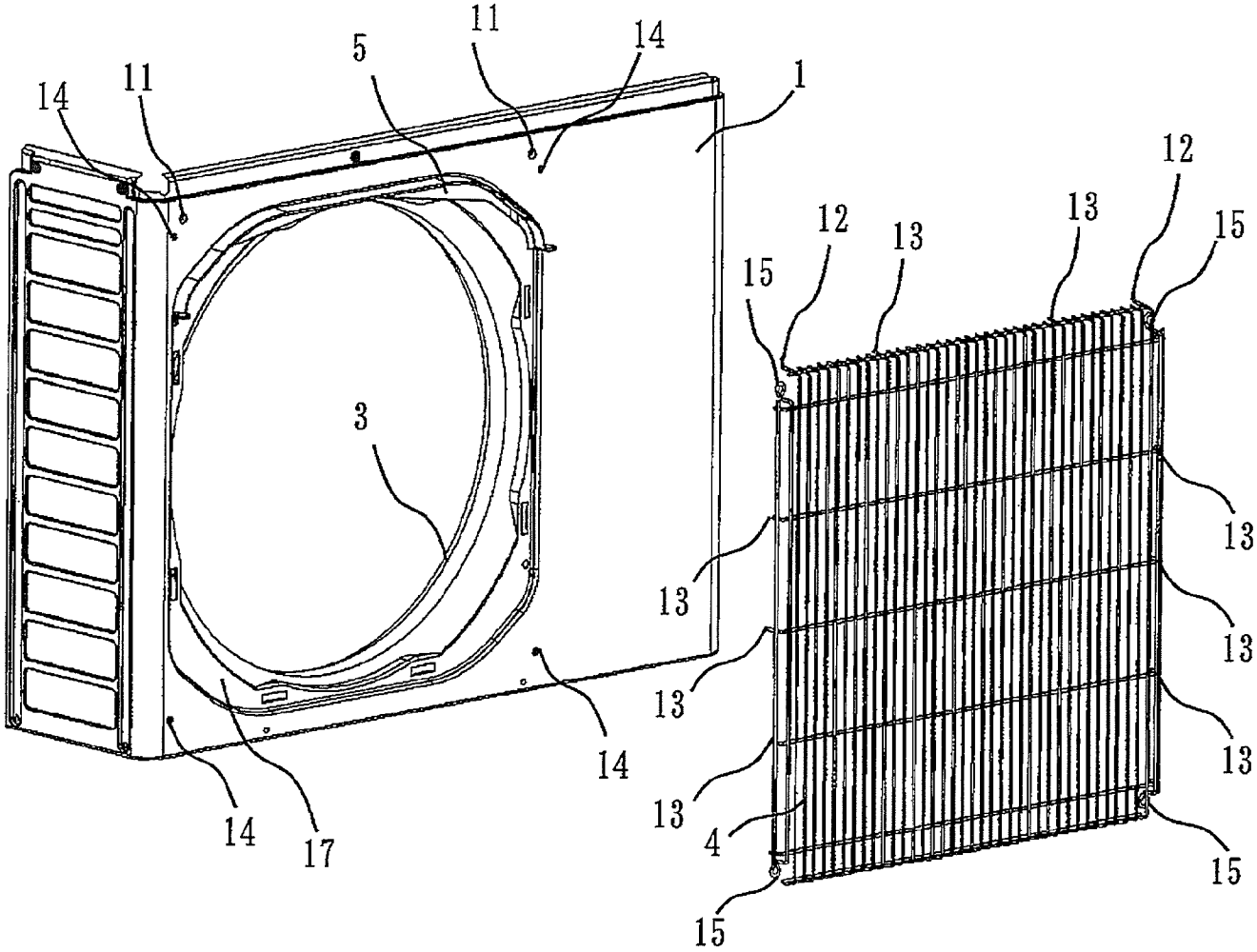
FIG. 9 is a diagram illustrating a state where the eaves member 5 is attached to and the outlet grille 4 is detached from the front panel 1.
Figure 10:
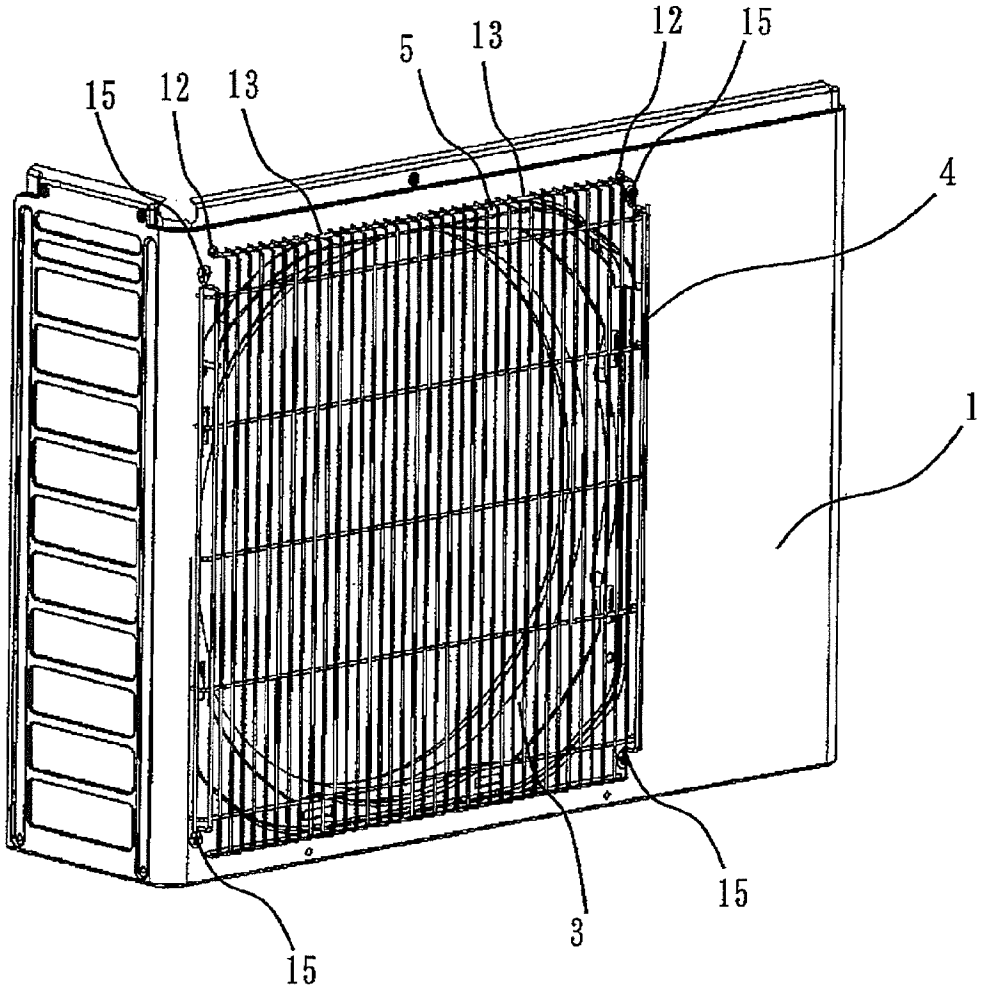
FIG. 10 is a diagram illustrating a state where the eaves member 5 and the outlet grille 4 are attached to the front panel 1.

FIG. 9 and FIG. 10 are perspective view of the front surface part of the outdoor unit for the air conditioner according to the second embodiment. Particularly, FIG. 9 is the diagram illustrating the state where the eaves member 5 is attached to and the outlet grille 4 is detached from the front panel 1. FIG. 10 is the diagram illustrating the state where the eaves member 5 and the outlet grille 4 are attached to the front panel 1.

Figure 11:
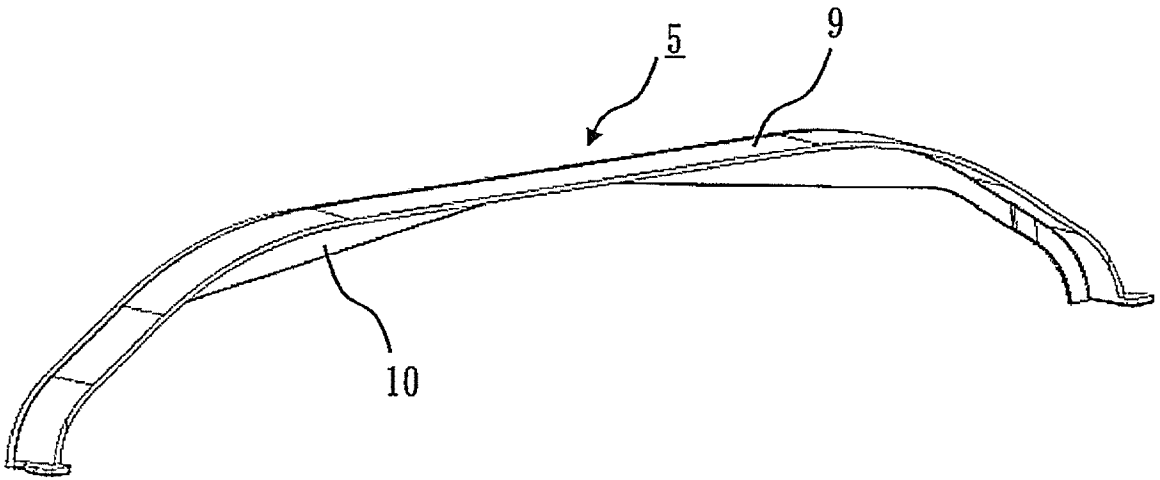
FIG. 11 is a front perspective view of the eaves member 5 according to the second embodiment.

FIG. 11 is the front perspective view of the eaves member 5 according to the second embodiment.

Figure 12:
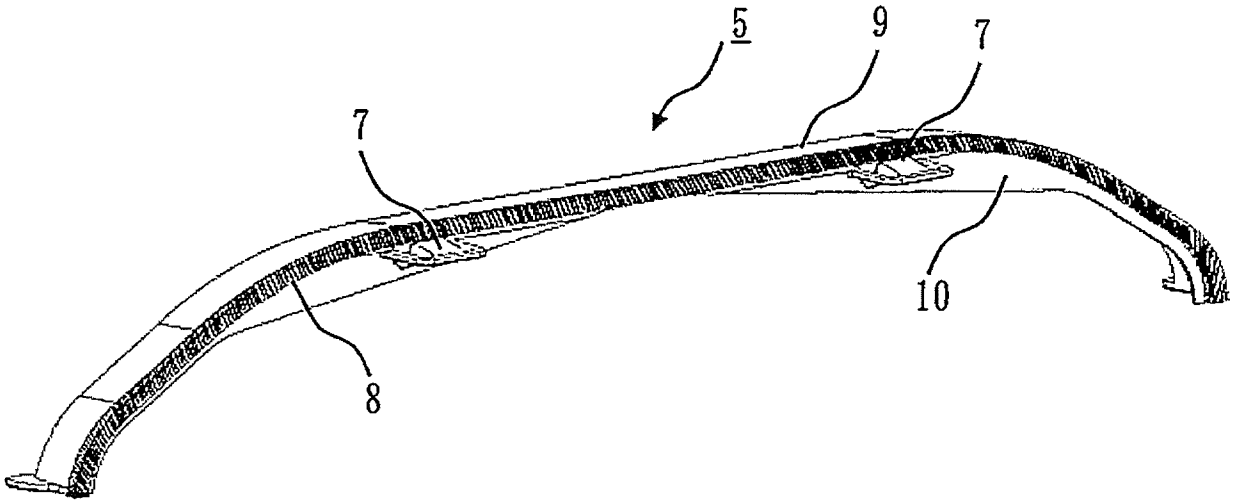
FIG. 12 is a back perspective view of the eaves member 5 according to the second embodiment.

FIG. 12 is the back perspective view of the eaves member 5 according to the second embodiment.

As illustrated in FIG. 9, a bell mouth surrounding part 17 in an approximately octagon shape is formed in the front panel 1. Further, the eaves member 5 is formed in a shape following the bell mouth surrounding part 17. That is, it is formed to follow a side on an upside of the octagon shape, and two sides on the right and left of the side inclining downward.

Further, as illustrated in FIG. 11 and FIG. 12, the eaves member 5 is formed to have an overall cross section in L shape. That is, the adherence section 10 is formed only on the lower side of the protruding section 9 as a whole. In other words, the protruding section 9 is formed at the upper end of the eaves member 5. Additionally, the width of the adherence section 10 in the vicinity of the center part in the lateral direction is small to prevent the adherence section 10 from protruding to the air path side of airflow generated by the fan.

Further, as illustrated in FIG. 12, the seal member 8 is formed to follow the upper end of the adherence section 10 of the eaves member 5. That is, the seal member 8 is formed to follow the protruding section 9 provided at the upper end of the eaves member 5.

In the outdoor unit for the air conditioner according to the second embodiment, it is possible to prevent water droplets from flowing into the gap between the bell mouth 3 and the fan 2 as in the outdoor unit for the air conditioner according to the first embodiment.

Particularly, the seal member 8 is formed along the protruding section 9 in addition to the protruding section 9 being provided at the upper end of the eaves member 5, hence water droplets do not enter into the gap between the front panel 1 and the eaves member 5.

Further, as illustrated in FIG. 10, the outlet grille 4 is fixed to the front panel 1 by securing four corners of the front panel 1 with screws. That is, in a state where the eaves member 5 is attached to the front panel 1, the extension portions 12 in the outlet grille 4 are inserted into the grille attaching holes 11 formed in the section of the bell mouth surrounding part 17, and further, four screws passed through the screw fixing portions 15 formed at the four corners of the outlet grille 4 are inserted into four screw holes 14 formed in the section of the bell mouth surrounding part 17 and secured. As explained above, the similar effect as in the outdoor unit for the air conditioner according to the first embodiment can be attained even in a case in which four corners are fixed with screws.

The above-mentioned embodiments are summarized as follows.

An outdoor unit for an air conditioner includes a circular bell mouth protruding inward at an air outlet of a fan in a front panel, the outdoor unit for the air conditioner whereto an outlet grille to cover an external part of the air outlet is attached, wherein an eaves part with a width equal to or larger than a diameter of the air outlet is formed on an inner side of the outlet grille from the front panel to an outside, and a clearance exists between an end of the eaves part and a mesh part of a grille.

Further, the eaves part has falling gradients toward right and left ends, and a gap between a top surface of the eaves part and the inner side of the outlet grille is larger at the right and left ends than at a center part.

Further, a member forming the eaves part includes a lug to be inserted into a hole in the front panel and secured making use of elasticity, whereof a rear surface is provided with a seal member to seal a gap between the member and the front panel.

In addition, the eaves part further has a falling gradient from the front panel toward the outside.

In addition, flame-retarded plastic is used as a material of the eaves part.

The outdoor unit for the air conditioner according to the present invention can prevent water droplets from flowing into the gap between the fan and the bell mouth with a simple structure.

Having thus described several particular embodiments of the present invention, various alterations, modifications, and improvements will readily occur to those skilled in the art. Such alterations, modifications, and improvements are intended to be part of this disclosure, and are intended to be within the spirit and scope of the present invention. Accordingly, the foregoing description is by way of example only, and is not intended to be limiting. The present invention is limited only as defined in the following claims and the equivalents thereto.

What is claimed is:

1. An outdoor unit for an air conditioner comprising:

a casing to store a fan;

a bell mouth to form an air outlet for an airflow that is generated by the fan stored in the casing;

an outlet grille to cover the air outlet formed by the bell mouth; and an eaves member that is placed above the air outlet in close adherence with the casing, and being placed with a space from the outlet grille, the eaves member including a protruding part that protrudes toward an outlet grille side, the protruding part including an adherence part that adheres closely with the casing, wherein the adherence part, on both first and second end sides of the eaves member, is formed on both upper and lower sides of the protruding part, the adherence part formed on the lower side of the protruding part gradually becomes smaller toward a center part of the eaves member, and in the center part of the eaves member, the adherence part is formed only on the upper side of the protruding part.

2. The outdoor unit for the air conditioner as defined in claim 1, wherein the eaves member slants downward at both ends in a width direction.

3. The outdoor unit for the air conditioner as defined in claim 1, wherein the eaves member slants downward from a casing side to the outlet grill side.

4. The outdoor unit for the air conditioner as defined in claim 1, wherein the eaves member is formed of a flame-retardant plastic.

* * * * *